US009808917B1

(12) United States Patent
Chien

(10) Patent No.: US 9,808,917 B1
(45) Date of Patent: Nov. 7, 2017

(54) RATCHET WRENCH CAPABLE OF ROTATING QUICKLY AND DRIVING ROTATION

(71) Applicant: YIH CHENG FACTORY CO., LTD., Nantuo (TW)

(72) Inventor: Chih-Hung Chien, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 0 days.

(21) Appl. No.: 15/256,557

(22) Filed: Sep. 3, 2016

(51) Int. Cl.
*B25B 23/00* (2006.01)
*B25B 13/46* (2006.01)
*B25G 1/06* (2006.01)

(52) U.S. Cl.
CPC ..... *B25B 23/0028* (2013.01); *B25B 13/461* (2013.01); *B25G 1/063* (2013.01); *B25G 1/066* (2013.01)

(58) Field of Classification Search
CPC . B25B 23/0028; B25B 13/461; B25B 13/481; B25G 1/063; B25G 1/066
USPC ..... 81/177.9, 177.85, 177.75, 177.7
See application file for complete search history.

(56) References Cited

U.S. PATENT DOCUMENTS 1,453,607 A * 5/1923 Saucier ..... B25B 13/465 81/124.3
2,504,796 A * 4/1950 Boyd ..... B25B 23/0021 403/93
6,349,620 B1 * 2/2002 Anderson ..... B25G 1/063 81/177.9
7,246,544 B1 * 7/2007 Lee ..... B25B 13/461 81/177.8
7,281,452 B2 * 10/2007 Chang ..... B25B 13/46 81/177.2
7,878,091 B2 * 2/2011 Abel ..... B25B 13/461 81/177.9
7,975,575 B2 * 7/2011 Hu ..... B25B 13/461 81/177.7
8,511,206 B2 * 8/2013 Hong ..... B25B 23/0028 81/177.8
2006/0201288 A1 * 9/2006 Chen ..... B25B 13/461 81/177.8
2007/0256525 A1 * 11/2007 Lee ..... B25B 13/461 81/63.1

* cited by examiner

*Primary Examiner* — Larry E Waggle, Jr.
*Assistant Examiner* — Danny Hong
(74) *Attorney, Agent, or Firm* — Chun-Ming Shih; HDLS IPR Services

(57) ABSTRACT

A ratchet wrench capable of rotating quickly and driving rotation includes a handle, a rotary head, a positioning mechanism, and a sleeve. The handle includes an arm and a bar body. The bar body includes an accommodating slot; the arm includes a through hole. The rotary head is connected to the arm and includes recess portions. The positioning mechanism includes a positioning element, a resilient body, and a block element. The resilient body receives the positioning element and is received in the through hole, the positioning element is correspondingly disposed in any of the recess portions, and the block element is connected to the positioning element. The sleeve receives the bar body and operably drives the block element to slide in the accommodating slot, so that the positioning element is positioned and selectively engaged with any recess portion.

7 Claims, 9 Drawing Sheets

RATCHET WRENCH CAPABLE OF ROTATING QUICKLY AND DRIVING ROTATION

TECHNICAL FIELD

The present invention relates to a wrench and, in particular, to a ratchet wrench capable of rotating quickly and driving rotation.

BACKGROUND

The ratchet wrench is a common hand tool for tightening or loosening operations. The ratchet wrench can be used flexibly and can move back and forth freely to tighten or loosen blots, screws, or the likes, so it replaces a traditional wrench in many situations.

The conventional ratchet wrench includes a head portion, a bar extending outwardly from the head portion, and a coupling member disposed on the head portion. The coupling member is drivingly associated with objects, e.g. nuts and bolts, by means of a variety of sleeves in different sizes. A user simply needs to hold the bar to swing it, and the objects can be loosened or tightened.

However, the conventional ratchet wrench is often limited by a dead corner or a tiny space, and thereby the coupling member of the ratchet wrench cannot fasten the objects smoothly. In solution, there is a ratchet wrench with a coupling member rotatable with respect to the bar.

However, the ratchet wrench with the rotatable coupling member has a complicated structure for fixing the coupling member, and its inconvenient operations cannot meet the market's expectations.

SUMMARY

It is an object of the present invention to provide a ratchet wrench capable of rotating quickly and driving rotation, which allows a rotary head to be rotated at an arm, thereby facilitating easy and convenient operations of the ratchet wrench.

Accordingly, the present invention provides a ratchet wrench capable of rotating quickly and driving rotation, comprising a handle, a rotary head, a positioning mechanism, and a sleeve. The handle includes an arm and a bar body connected to the arm. The bar body includes an accommodating slot, and the arm includes a through hole communicating with the accommodating slot. The rotary head is connected to the arm and is rotatable with respect to the arm. The rotary head includes a plurality of recess portions. The positioning mechanism includes a positioning element, a resilient body, and a block element. The resilient body receives the positioning element and is received in the through hole. One end of the positioning element is correspondingly disposed at any of the recess portions. The block element is connected to the other end of the positioning element and is received in the accommodating slot. The sleeve receives the bar body while disposed corresponding to the accommodating slot, and the sleeve operably drives the block element to slide in the accommodating slot, so that the positioning element is positioned and selectively engaged with any of the recess portions.

The present invention further has the following functions. By utilizing an inner ring body and an outer ring body to together clamp a bump of the block element, assembly can be achieved easily. By the cover in contact against the level, the block element can move stably in the accommodating slot. The sleeve can be operated by one hand, thus facilitating easy and convenient operations.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
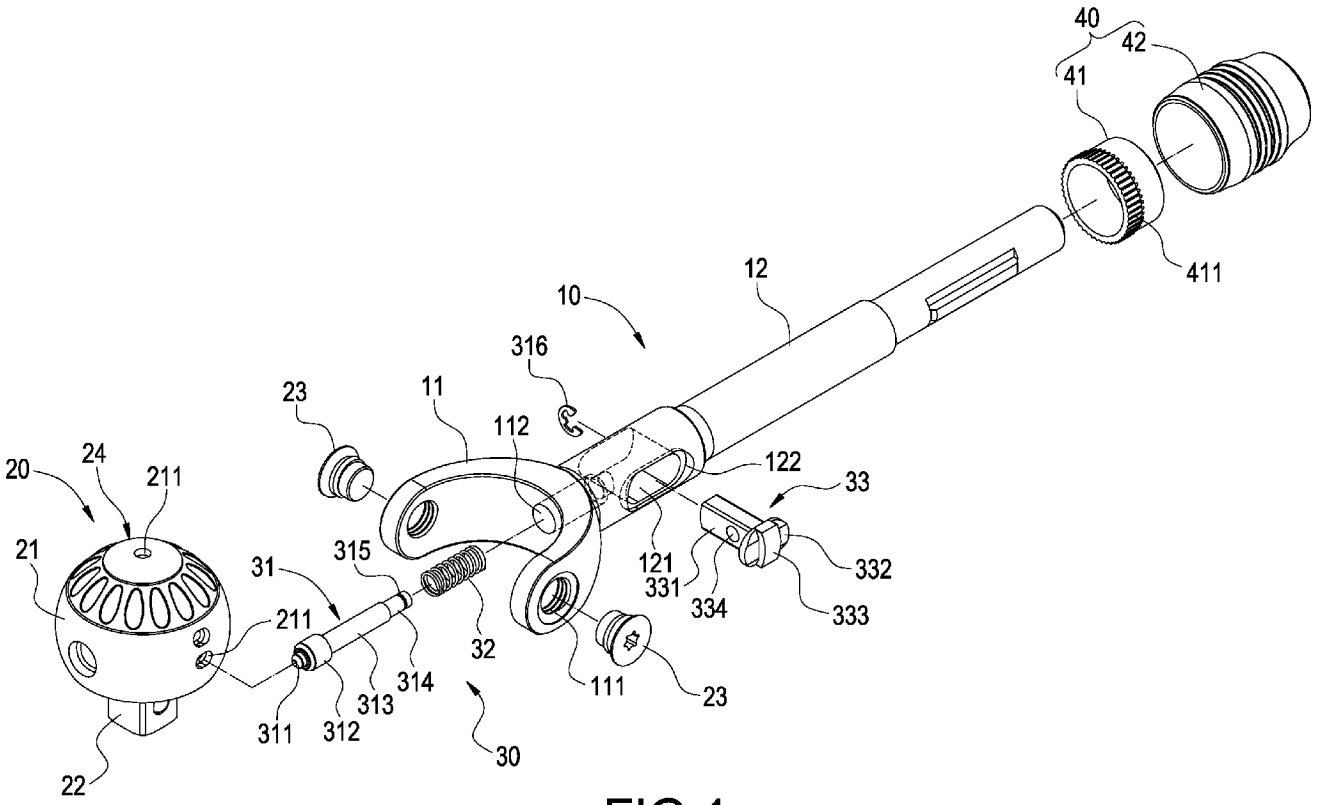
FIG. 1 is a perspective exploded view of a ratchet wrench according to the present invention.
Figure 2:
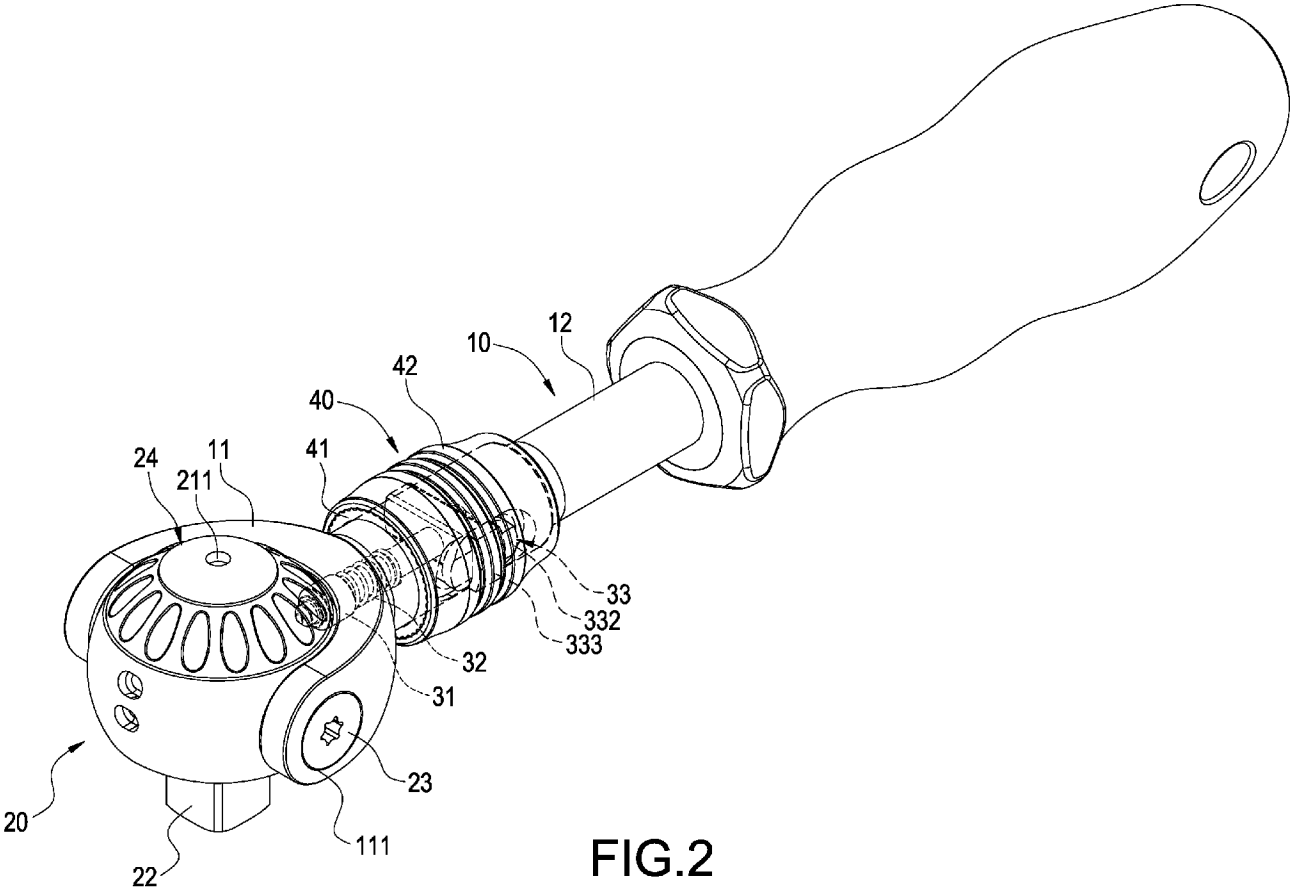
FIG. 2 is an assembled view of the present invention, illustrating that a rotary head is perpendicular to a handle.
Figure 3:
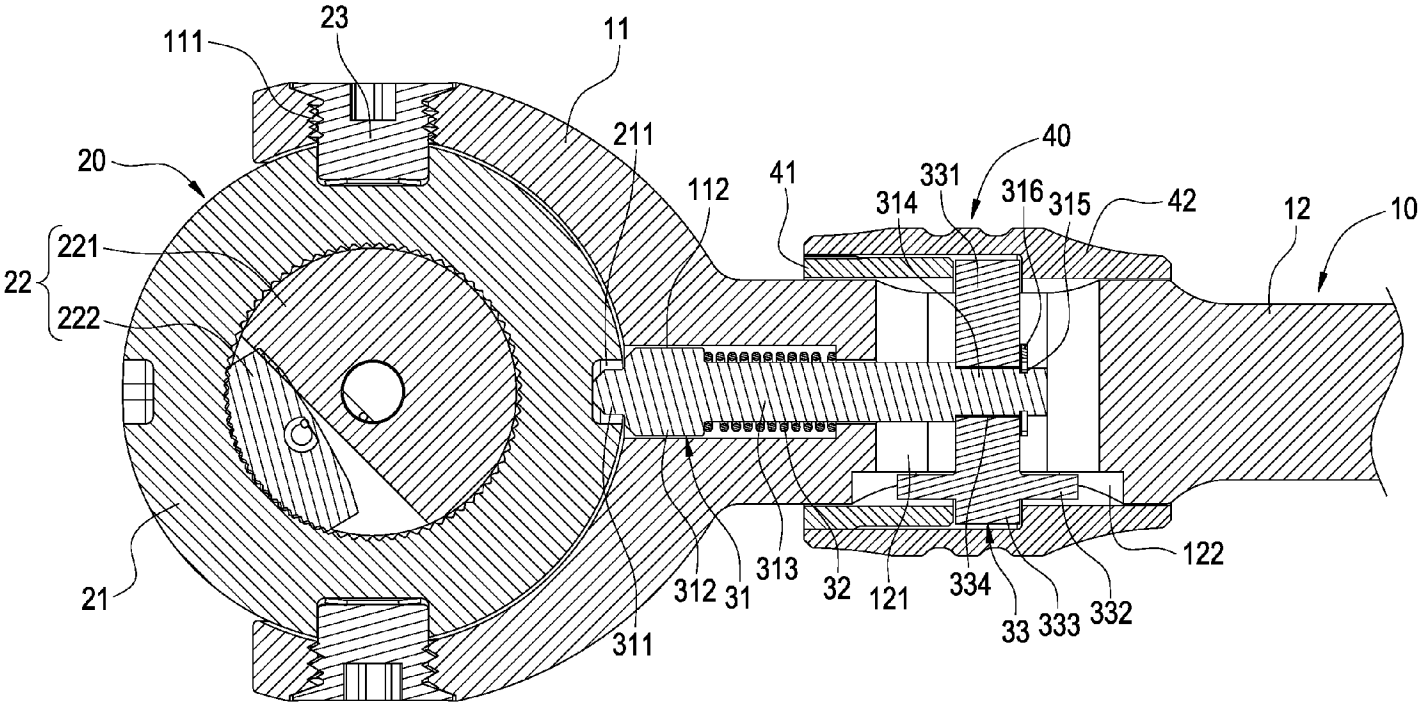
FIG. 3 is a partial cross-sectional view of FIG. 2.

Referring to FIGS. 1 to 3, the present invention provides a ratchet wrench capable of rotating quickly and driving rotation. The ratchet wrench mainly includes a handle 10, a rotary head 20, a positioning mechanism 30, and a sleeve 40.

The handle 10 includes an arm 11 and a bar body 12 extending outwardly from a bottom end of the arm 11. The arm 11 is of a U shape, and two ends of its open side have two threaded hole respectively. A close side of the arm 11 includes a through hole 112. The bar body 12 includes an accommodating slot 121 close to the arm 11, and the accommodating slot 121 is in communication with the through hole 112. A periphery of the accommodating slot 121 is disposed with a level 122.

The rotary head 20 includes an outer housing 21 and a coupling assembly 22 assembled at the outer housing 21. The outer housing 21 has a half ball shape, and is fastened to each of the threaded holes 111 by means of a threaded fastening element 23, such as bolts, inserted therein, so that the rotary head 20 can be assembled onto the arm 11, and the rotary head 20 can rotate with respect to the arm 11. A plurality of recess portions 211 are formed on the outer housing 21 to be disposed corresponding to the through hole 112. In the present embodiment, the recess portion 211 is, but not limited to, an indentation. Further, in the present embodiment, there are five recess portions 211 formed at a center of the outer housing 21 and at two opposite sides of a side surface of the outer housing 21. The coupling assembly 22 includes a ratchet member 221 and a ratchet block 222 (see FIG. 4), and these components relate to conventional techniques, so a detailed description thereof is omitted for brevity.

The positioning mechanism 30 includes a positioning element 31, a resilient body 32, and a block element 33. The positioning element 31 includes a contact pillar 311, a constraint section 312 extending backwards from the contact pillar 311, a rod section 313 extending backwards from the constraint section 312, and an end section 314 extending backwards from the rod section 313. The end section 314 includes a fastening groove 315 for engagement with a fastening ring 316. In the embodiment, the resilient body 32 is, but not limited to, a coil compression spring. The resilient body 32 receives an outer periphery of the rod section 313, and the resilient body 32 and the positioning element 31 are together received in the through hole 112. The block element 33 includes a rectangular bar 331, a cover 332 extending from the rectangular bar 331, and a bump 333 extending from the cover 332. The rectangular bar 331 includes a penetration hole 334 for insertion of the end section 314. The cover 332 is in contact with the level 122. By means of the fastening ring 316 that is fastened and engaged with the fastening groove 315, the block element 33 is assembled in the accommodating slot 121, and at the same time the resilient body 32 is resiliently clamped between the constraint section 312 and a bottom of the through hole 112 of the arm 11.

The sleeve 40 includes an inner ring body 41 and an outer ring body 42. A plurality of tooth portions 411 is disposed on an outer periphery of the inner ring body 41. The inner ring body 41 is arranged corresponding to the accommodating slot 121 to receive an outer periphery of the bar body 12. The outer ring body 42 is also arranged corresponding to the accommodating slot 121 to receive the bar body 12. The inner ring body 41 is pressed inwardly of the outer ring body 42, and the inner ring body 41 and the outer ring body 42 together clamp the bump 333. The inner ring body 41 is fastened and engaged with the outer ring body 42 by means of each tooth portion 411. Meanwhile, the sleeve 40 can be axially movable backwards and forwards on the bar body 12, thereby operably driving the block element 33 to slide in the accommodating slot 121, so that the positioning element 31 is positioned and selectively engaged with any of the recess portions 211.

The ratchet wrench is constructed using the above-mentioned components. The contact pillar 311 is correspondingly engaged with the recess portion 211 at the side surface of the outer housing 21 of the rotary head 20, so that the ratchet member 221 of the rotary head 20 is oriented to be perpendicular to the bar body 12 of the handle 10. Then, various hand tools can be coupled to an end portion of the ratchet member 221 of the ratchet wrench, and thereby the ratchet wrench can be utilized to drive rotation by force.

Figure 4:
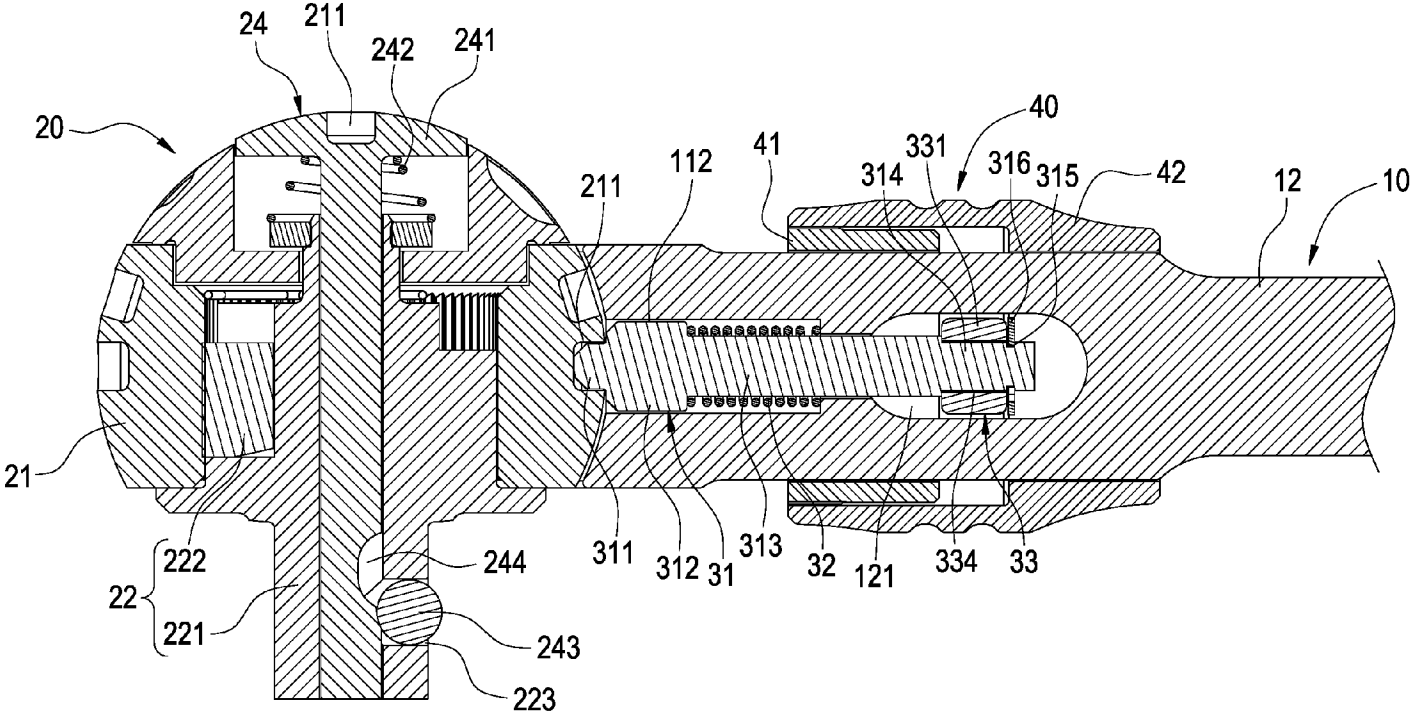
FIG. 4 is an assembled cross-sectional view of the present invention, showing that a sleeve is moved away from an arm.

Referring to FIG. 4, the rotary head 20 of the present invention includes an engagement mechanism 24. A ball receiving hole 223 is formed on a lateral side of the ratchet member 221 exposed from the outer housing 21. The engagement mechanism 24 includes a push rod 241, a volute spring 242 and a round ball 243. The recess portion 211 is formed on an end surface of the push rod 241. The push rod 241 includes a notch 244 at another side. The push rod 241 is inserted through a center of the ratchet member 221. The volute spring 242 is resiliently clamped between an end portion of the push rod 241 and the ratchet member 221. The round ball 243 is assembled between the ratchet member 221 and the push rod 241 and is disposed corresponding to the ball receiving hole 223.

Figure 5:
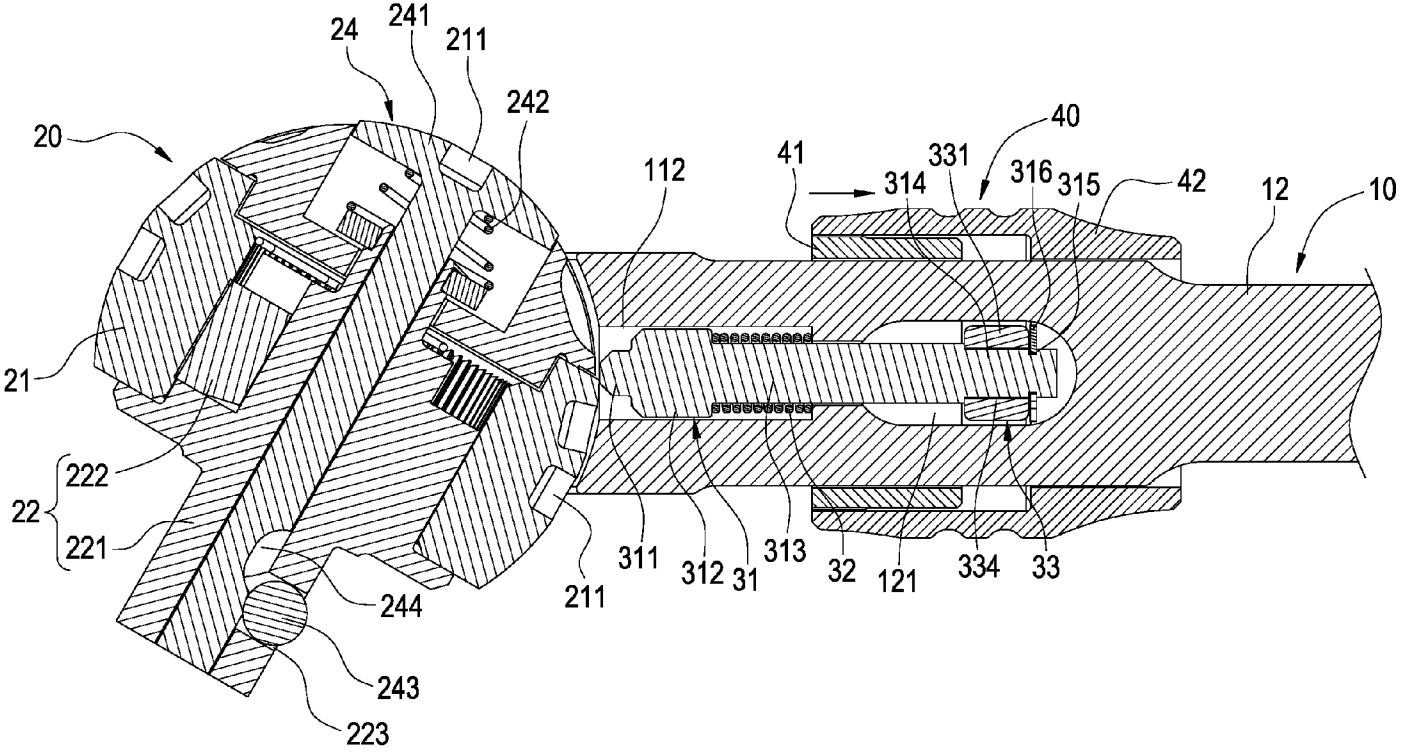
FIG. 5 is a cross-sectional view of the present invention, illustrating that the rotary head is rotated.
Figure 6:
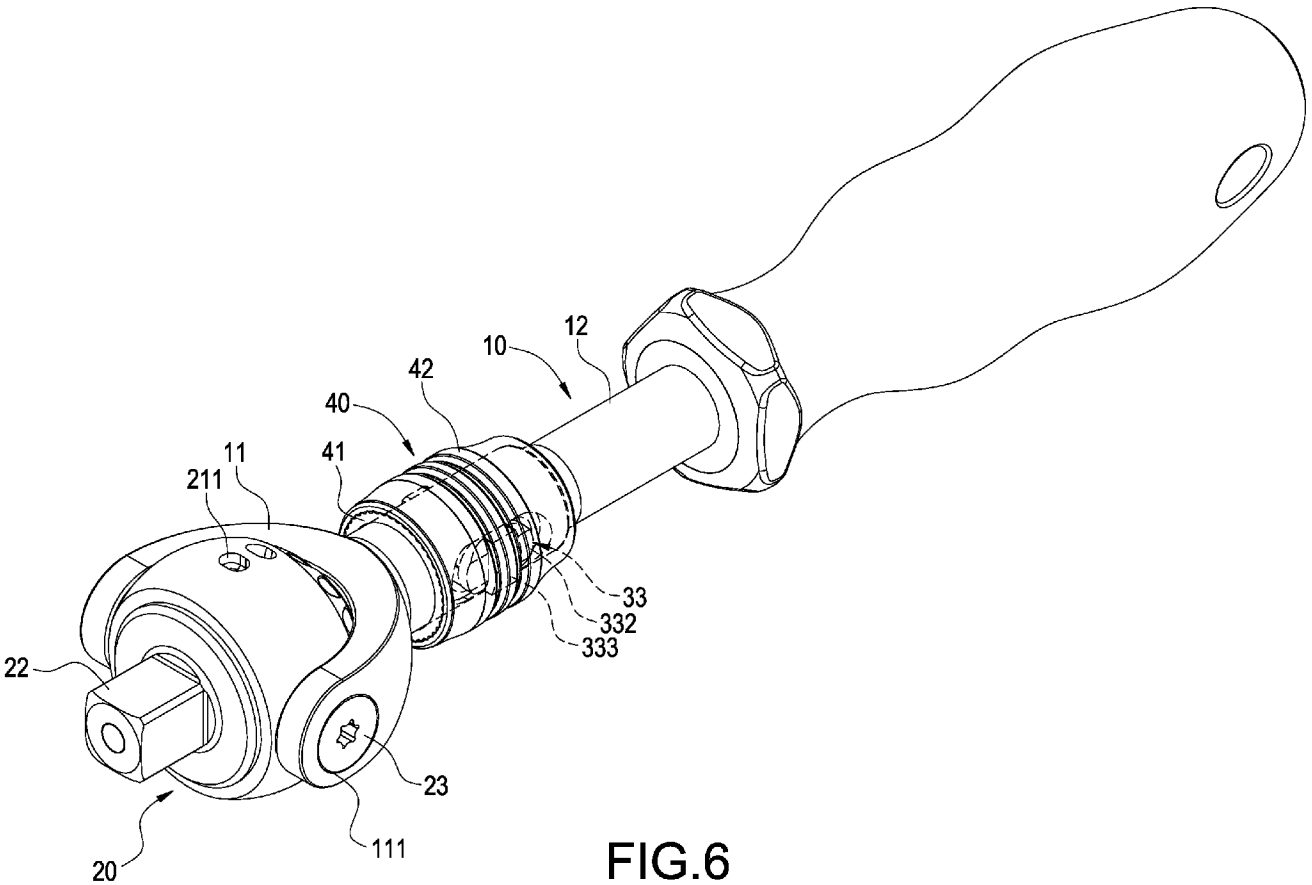
FIG. 6 is an assembled view of the present invention, illustrating that the rotary head is adjusted to be parallel to the handle.
Figure 7:
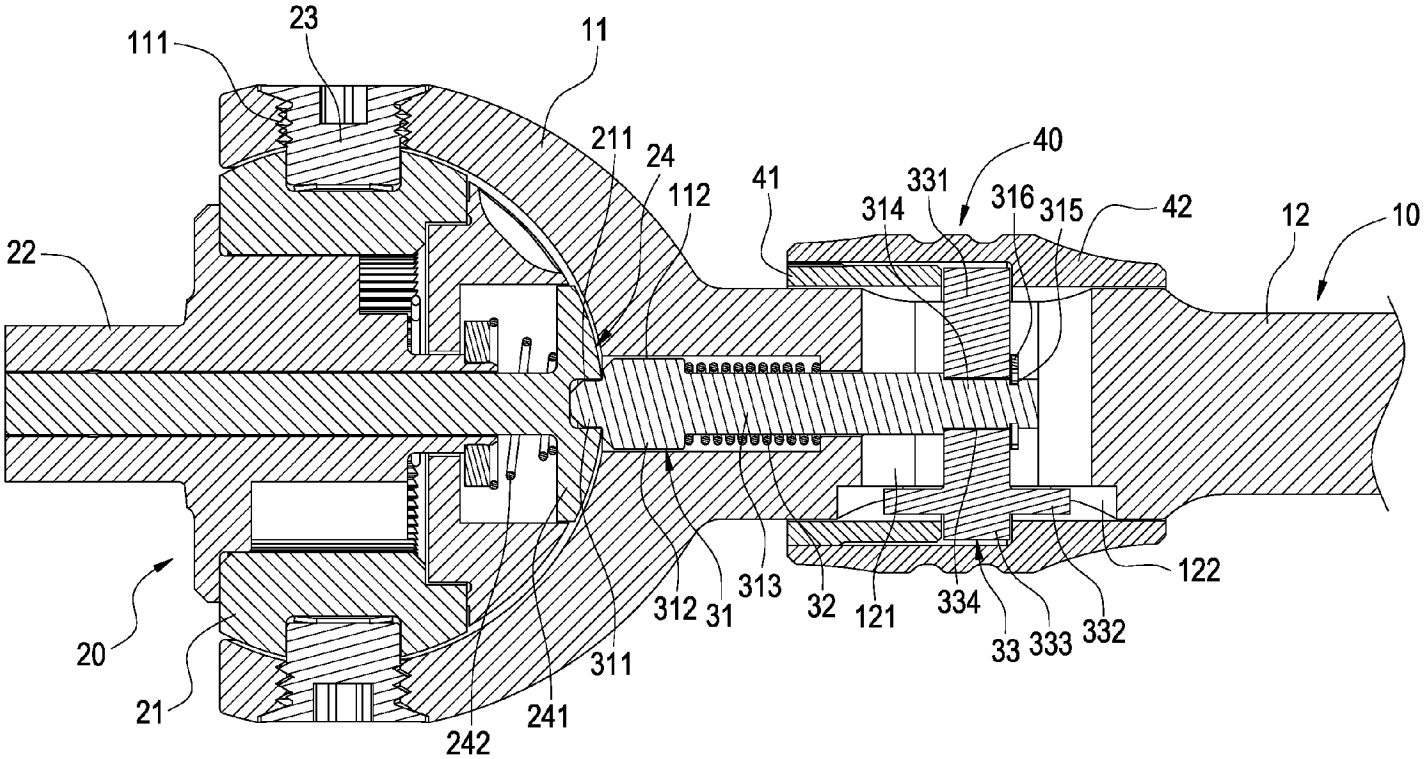
FIG. 7 is a partial cross-sectional view of FIG. 6.

Referring to FIGS. 5 to 7, when it is desired to rotate the rotary head 20 to different orientations, this can be done by one hand. First, a user holds the handle 10 by his/her palm and three fingers. Then, the user presses the sleeve 40 by the thumb and forefinger. Next, move the sleeve 40 away from the arm 11, so the sleeve 40 drives the block element 33 to move in the accommodating slot 121, and the positioning element 31 retracts into the through hole 112, and as a result, the contact pillar 311 is disengaged from the recess portion 211. At this point, the rotary head 20 rotates about a pivot point between the rotary head 20 and the arm 11. Then, the contact pillar 311 of the positioning element 31 is fastened and engaged with the recess portion 211 of the push rod 241.

When the contact pillar 311 is engaged with the recess portion 211 of the push rod 241 of the rotary head 20, the ratchet member 221 of the rotary head 20 is parallel to the bar body 12 of the handle 10. Then, a desired hand tool can be coupled to the end portion of the ratchet member 221 of the ratchet wrench. After that, by holding the sleeve 40 with one hand and rotating the handle 10 with the other hand, the ratchet wrench can drive stable and rapid rotation.

Figure 8:
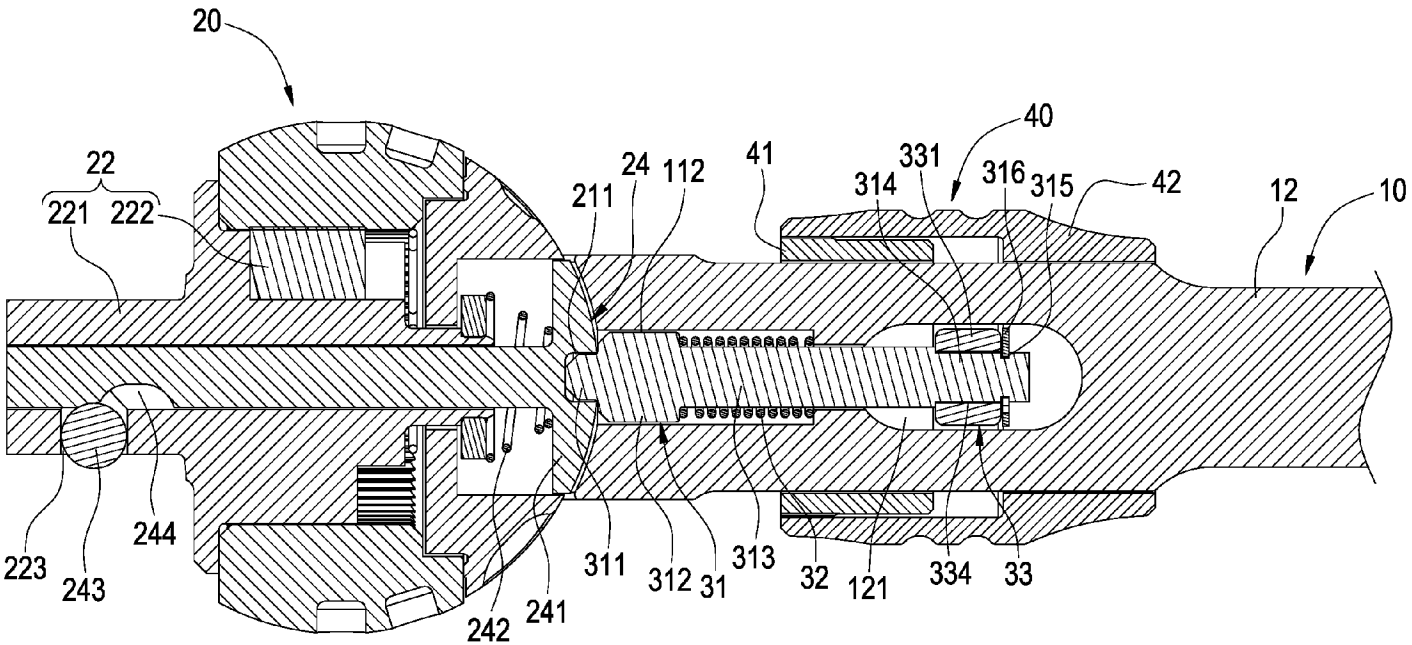
FIG. 8 is a cross-sectional view of the present invention, illustrating an engagement mechanism in use.
Figure 9:
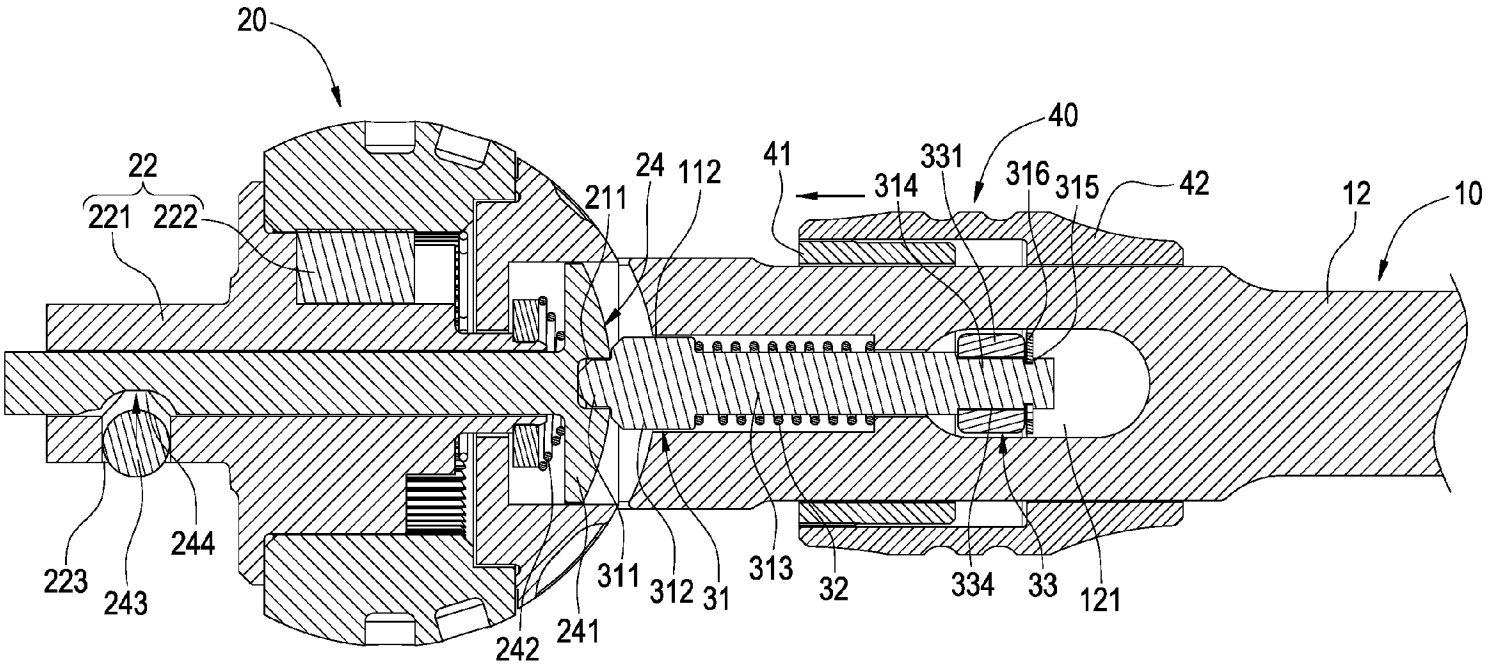
FIG. 9 is another cross-sectional view of the present invention, illustrating the engagement mechanism in use.

Referring to FIGS. 8 and 9, the push rod 241 of the engagement mechanism 24 in a normal state is under a force of the volute spring 242, the push rod 241 pushes the round ball 243 in the ball receiving hole 223, and thereby the desired tool (not illustrated) is stably secured to a coupling section of the ratchet member 221. When it is desired to disengage the desired tool from the coupling section of the ratchet member 221, the user simply holds the handle 10 with the palm and four fingers, and then pushes the sleeve 40 by the thumb to move with respect to the handle 10, the positioning element 31 will push the push rod 241 and compress the volute spring 242 to cause push rod 241 to move outwardly toward the ratchet member 221. When the notch 244 of the push rod 241 is arranged corresponding to the round ball 243, the round ball 243 falls into the notch 244, so the round ball 243 does not exert a force onto the desired tool, and thereby the tool can be easily disengaged from the coupling section of the ratchet member 221.

In the ratchet wrench of the present invention, by using a single-hand operation, the rotary head 20 can rotate quickly or drive rotation by force. In addition, disengaging the ratchet member 221 from the tool can also be done using the single-hand operation, and thus it is easy and convenient to use the present invention.

In summary, the ratchet wrench capable of rotating quickly and driving rotation of the present invention certainly can achieve anticipated objectives and solve the conventional defects. The present invention also has novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. A ratchet wrench capable of rotating quickly and driving rotation, comprising:

a handle including an arm and a bar body connected to the arm, the bar body including an accommodating slot, the arm including a through hole communicating with the accommodating slot;

a rotary head, the rotary head being connected to the arm and being rotatable with respect to the arm, the rotary head including a plurality of recess portions;

a positioning mechanism, the positioning mechanism including a positioning element, a resilient body, and a block element, the resilient body receiving the positioning element and being received in the through hole, one end of the positioning element being correspondingly disposed at any of the recess portions, the block element being connected to the other end of the positioning element and being received in the accommodating slot; and a sleeve, the sleeve receiving the bar body while disposed corresponding to the accommodating slot the sleeve operably driving the block element to slide in the accommodating slot, so that the positioning element is positioned and selectively engaged with any of the recess portions, wherein the positioning element includes a contact pillar, a constraint section extending from the contact pillar, and a rod section extending from the constraint section, the contact pillar is correspondingly engaged with any of the recess portions, and the resilient body receives the rod section to be resiliently clamped between the constraint section and a bottom of the through hole;

wherein the positioning element further includes an end section extending from the rod section, the end section includes a fastening groove, the block element includes a rectangular bar, the rectangular bar includes a penetration hole, and the end section passes through the penetration hole and is fastened by a fastening ring engaged with the fastening groove.

2. The ratchet wrench capable of rotating quickly and driving rotation of claim 1, wherein the block element includes a bump, the sleeve includes an inner ring body and an outer ring body, the inner ring body receives the bar body while disposed corresponding to the accommodating slot, the outer ring body correspondingly receives the inner ring body, and the outer ring body and the inner ring body together clamp the bump.

3. The ratchet wrench capable of rotating quickly and driving rotation of claim 2, and a cover extending from the rectangular bar, and the bump extends from the cover to be away from the rectangular bar.

4. The ratchet wrench capable of rotating quickly and driving rotation of claim 1, wherein the block element further includes a cover extending from the rectangular bar, a periphery of the accommodating slot is disposed with a level, and the cover is in contact with the level.

5. The ratchet wrench capable of rotating quickly and driving rotation of claim 4, wherein the block element further includes a bump extending from the cover the sleeve includes an inner ring body and an outer ring body, the inner ring body receives the bar body while disposed corresponding to the accommodating slot, the outer ring body correspondingly receives the inner ring body, and the outer ring body and the inner ring body together clamp the bump.

6. A ratchet wrench capable of rotating quickly and driving rotation, comprising:

a handle including an arm and a bar body connected to the arm, the bar body including an accommodating slot, the arm including a through hole communicating with the accommodating slot;

a rotary head, the rotary head being connected to the arm and being rotatable with respect to the arm, the rotary head including a plurality of recess portions;

a positioning mechanism, the positioning mechanism including a positioning element, a resilient body, and a block element, the resilient body receiving the positioning element and being received in the through hole, one end of the positioning element being correspondingly disposed at any of the recess portions, the block element being connected to the other end of the positioning element and being received in the accommodating slot; and a sleeve, the sleeve receiving the bar body while disposed corresponding to the accommodating slot the sleeve operably driving the block element to slide in the accommodating slot, so that the positioning element is positioned and selectively engaged with any of the recess portions, wherein the rotary head includes an outer housing and a coupling assembly assembled at the outer housing, and the recess portions are formed on the coupling assembly and on two opposite sides at a side surface of the outer housing;

wherein the coupling assembly includes a ratchet member and an engagement mechanism, a ball receiving hole is formed on a lateral side of the ratchet member, and the engagement mechanism includes a push rod and a round ball, and wherein one of the recess portions is formed on an end surface of the push rod, the push rod includes a notch, the push rod is inserted through the ratchet member, and the round ball is assembled between the ratchet member and the push rod and is disposed corresponding to the ball receiving hole.

7. The ratchet wrench capable of rotating quickly and driving rotation of claim 6, wherein the engagement mechanism further includes a volute spring, and the volute spring is resiliently clamped between the push rod and the ratchet member.

* * * * *